United States Patent [19]

Corey

[11] Patent Number: 4,896,800

[45] Date of Patent: Jan. 30, 1990

[54] SIPHON PURGE SYSTEM

[75] Inventor: Michael D. Corey, Worthington, Minn.

[73] Assignee: Crystal Tips, Inc., Spirit Lake, Iowa

[21] Appl. No.: 224,942

[22] Filed: Jul. 27, 1988

[51] Int. Cl.[4] ..... F04F 10/00

[52] U.S. Cl. ..... 222/416; 137/132; 137/152

[58] Field of Search ..... 222/416, 204; 137/132, 137/143, 146, 150.5, 152, 153, 133, 135, 136; 4/368, 375

[56] References Cited

U.S. PATENT DOCUMENTS

| | | | |
|---|---|---|---|
| 359,502 | 3/1887 | Denison | 222/204 X |
| 466,336 | 1/1892 | Franklin | 222/204 |
| 800,227 | 9/1905 | Martin | 4/375 |
| 974,336 | 11/1910 | Alt | 222/416 |
| 1,030,378 | 6/1912 | Bechwith | 222/416 |
| 1,037,791 | 9/1912 | Miller | 137/143 |
| 2,118,532 | 5/1938 | Widmann | 137/152 |
| 2,589,068 | 7/1947 | Evans, Jr. | 222/416 |
| 2,775,100 | 12/1956 | Howe | 4/368 X |
| 3,033,222 | 5/1962 | Connolly | 137/152 |
| 3,265,371 | 8/1966 | McGrath | 137/143 X |
| 3,339,801 | 9/1967 | Hronas | 222/416 X |
| 3,407,621 | 10/1968 | Dedricks et al. | 137/143 X |
| 4,361,522 | 11/1982 | Goettl | 137/132 X |
| 4,363,220 | 12/1982 | Ripley | 62/138 |

FOREIGN PATENT DOCUMENTS

| | | | |
|---|---|---|---|
| 314343 | 1/1934 | Italy | 272/416 |
| 364183 | 1/1932 | United Kingdom | 137/146 |
| 1178112 | 1/1970 | United Kingdom | 222/204 |
| 2074833 | 11/1981 | United Kingdom | 222/416 |

*Primary Examiner*—F. J. Bartuska
*Assistant Examiner*—Boris Milef
*Attorney, Agent, or Firm*—Connolly and Hutz

[57] ABSTRACT

A siphon purge system functions to remove water and accumulated sediment from the water reservoir of an ice making machine. The system includes an inverted U-shaped tube mounted in the reservoir, the tube having an inlet leg portion, an opposed outlet leg portion and an interconnecting bight portion. The outlet leg portion is connected to a drain in the reservoir while the inlet leg portion has an open entrance end positioned in close proximity to the bottom of the water reservoir. A siphon breaker opening in the bight portion of the U-shaped tube controls water flow through the tube as follows. Water drains through the tube when the water level in the reservoir rises to the level of the bight portion, and the water continues to drain until the level reaches the full height of the bight portion. At that point, water and accumulated sediment are siphoned from the bottom of the reservoir through the inverted U-shaped tube and such siphoning continues until the water level drops below the siphon breaker opening at which time the siphon action is broken.

5 Claims, 1 Drawing Sheet

SIPHON PURGE SYSTEM

BACKGROUND OF THE INVENTION

The present invention relates to a siphon purge system for an ice making machine, and more particularly to a siphon purge system for removing water and sediment from the water reservoir of such a machine.

Ice making machines of the type that circulate water over refrigerated surfaces include reservoirs from which water is drawn for the circulation process. Ice forms on the refrigerated surfaces and when a predetermined thickness is achieved, water circulation is terminated and the formed ice is harvested. Once during each cycle water in the reservoir is replenished, and the ice forming process is then repeated. Since ice formed in this manner is free of any water borne particles that may be associated with the supply water, such particles collect as sediment at the bottom of the reservoir. Periodic cleaning for removal of such sediment is therefore required.

In other ice making machines of this general type, no water is added during the ice forming stage. Instead the system is charged with water once and after ice formation the water is dumped and a fresh charge of water is introduced.

Heretofore, it has been proposed to totally or at least partially dump the water from the reservoir by mechanical or electrical means. This is done once for each cycle of operation. For the most part dumping of the water, and with it the collected sediment, is accomplished by opening a drain in the bottom of the reservoir, such as by an activated solenoid or the like. Disadvantages of this approach include more electrical and/or mechanical parts being added which will increase failure rates. Also, with warmer water replacing the total amount of dumped water, the freezing cycle takes much longer thereby requiring more energy. Not only does this make total dumping of the reservoir more expensive through added energy consumption but ice production rates are also slower requiring more time per cycle than what would otherwise be necessary with already chilled water in the reservoir.

SUMMARY OF THE INVENTION

Accordingly, it is an object of the present invention to avoid the problems of the prior art by providing a siphon purge system for an ice making machine which is simple in design but highly effective in removing accumulated sediment from the water reservoir of the machine.

Another object of the invention is a siphon purge system having relatively few parts and a mode of operation which is both efficient and highly dependable in removing sediment from the water reservoir of ice making machinery.

In accordance with the present invention, a siphon purge system is provided for removing water and accumulated sediment from the reservoir of an ice making machine. The system includes an inverted U-shaped tube mounted in the reservoir having an inlet leg portion, an opposed outlet leg portion and an interconnecting bight portion. The outlet leg portion is connected to a reservoir drain, and the inlet leg portion has an open entrance end positioned in close proximity to the bottom wall of the water reservoir. A siphon breaker opening is provided in the bight portion of the inverted U-shaped tube at the inside surface of the U-shape.

Water drains through the inverted U shaped tube when the water level in the reservoir rises to the level of the bight portion, and the water continues to drain until the level reaches the full height of the bight portion. At that point, water and accumulated sediment are siphoned from the bottom of the reservoir through the inverted U-shaped tube and such siphoning continues until the water level drops below the siphon breaker opening at which time the siphon action is broken.

An adjustable outlet tube may be utilized to connect the outlet leg portion of the inverted U-shaped tube and the drain in the reservoir. Preferably, the adjustable outlet tube is constructed and arranged to slidably receive the outlet leg portion whereby the inverted U-shaped tube is adjustable toward and away from the bottom wall of the reservoir. When the drain is located in the side wall of the reservoir, the adjustable outlet tube may be elbow shaped.

An adjustable inlet tube may be positioned at the open entrance end of the inlet leg portion of the inverted U-shaped tube. Preferably, the adjustable inlet tube is a section of straight tubing constructed and arranged to slidably receive the inlet leg portion whereby the inverted U-shaped tube is adjustable toward and away from the bottom wall of the reservoir and the open entrance end of the inlet leg portion is adjustable relative to the bottom wall of the reservoir.

BRIEF DESCRIPTION OF THE DRAWING

Novel features and advantages of the present invention in addition to those noted above will become apparent to persons of ordinary skill in the art from a reading of the following detailed description in conjunction with the accompanying drawing wherein similar reference characters refer to similar parts and in which.

DETAILED DESCRIPTION OF THE INVENTION

Figure 1:
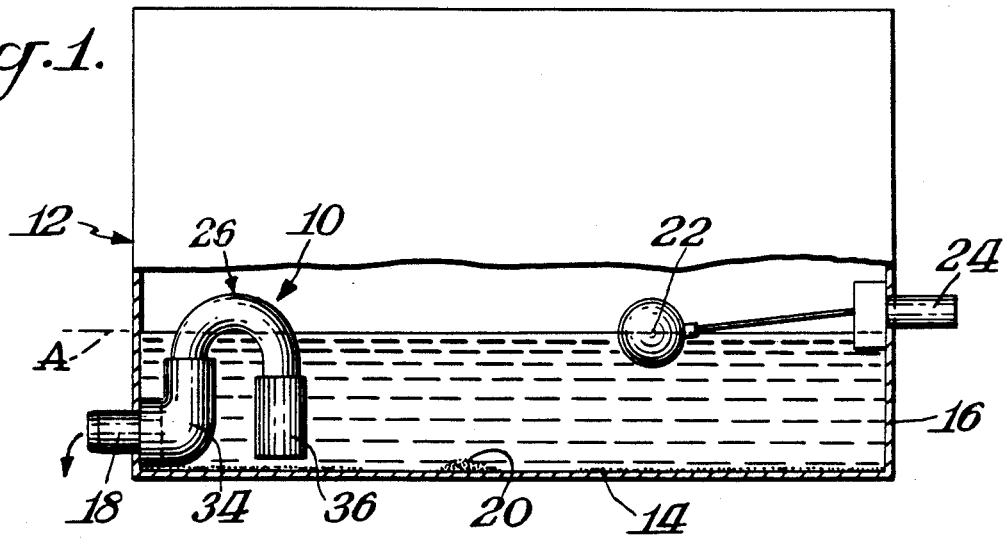
FIG. 1 is a sectional view of the water reservoir of an ice making machine with a siphon purge system therein, according to the present invention.

Referring in more particularity to the drawing, FIG. 1 illustrates a siphon purge system 10 positioned in the water reservoir 12 of an ice machine (not otherwise shown). Reservoir 12 includes a bottom wall 14 and an upwardly surrounding side wall 16. A drain 18 is located in the side wall of the reservoir. Once during each sequence or operational cycle of the machine, siphon purge system 10 functions to remove sediment 20 from the sump area of reservoir 12 which sediment might otherwise accumulate to objectionable levels. As explained more fully below, siphon purge system 10 "vacuums" the sediment without dumping all of the water in the reservoir.

During each cycle, the water level of reservoir 12 drops to a certain level thereby lowering a float assembly 22 which in turn opens a water supply inlet 24 to replenish the reservoir water. Once the desired water level is achieved, water supply inlet 24 is closed by the action of the float assembly.

Siphon purge system 10 of the present invention includes an inverted U-shaped tube 26 mounted in reservoir 12, the U-shaped tube having an inlet leg portion 28, an outlet leg portion 30, and an interconnecting bight portion 32. An adjustable elbow-shaped fitting 34 serves to connect the outlet leg portion 30 of inverted U-shaped tube 26 to the reservoir drain 18. Also, an adjustable inlet tube 36 is positioned at the end of the inlet leg portion 28 of the inverted U-shaped tube.

Inverted U-shaped tube 26 is adjustable relative to the bottom wall 14 of water reservoir 12. In this regard, the leg portions of tube 26 are slidably received in the adjustable outlet tube 34 and inlet tube 36. With this adjustability, inverted U-shaped tube 26 is appropriately positioned in the reservoir so that the open entrance of inlet tube 36 is in close proximity to the bottom wall 14 of the reservoir and the bight portion 32 is at the correct elevation, for reasons explained more fully below.

The adjustable inlet tube preferably comprises a piece of straight tubing the entrance opening of which is defined by a straight peripheral edge. However, it is also contemplated that the edge comprise a scalloped configuration. The spacing between the entrance opening and bottom wall 14 is identified in the drawing as distance D.

Figure 2:
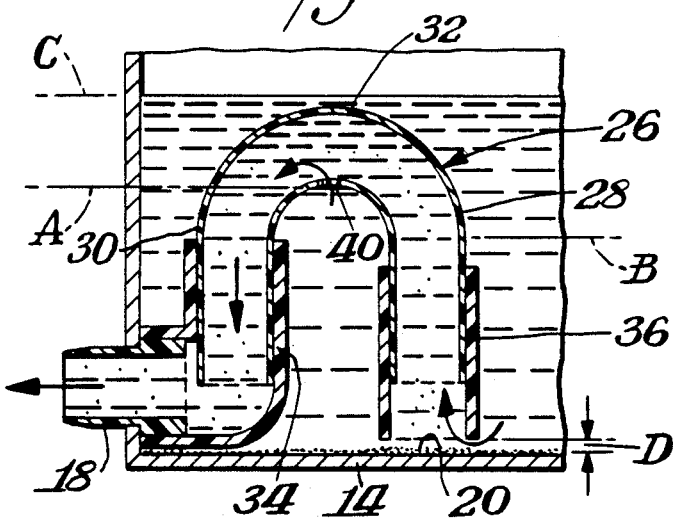
FIG. 2 is a view similar to FIG. 1 with the siphon purge system shown in section but illustrating a different segment of the sequence of operation than that shown in FIG. 1.
Figure 4:
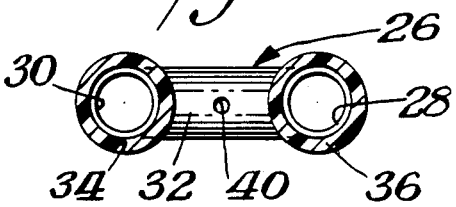
FIG. 4 is a sectional view taken along line 4—4 of FIG. 3.

As shown best in FIGS. 2 and 4, a siphon breaker opening 40 is provided in bight portion 32 of inverted U-shaped tube 26 for the purpose of breaking the siphon action of the flow through purge system 10, as explained more fully below. Opening 40 is located on the inside surface of the U-shaped tube 26.

Water level A shown in the drawing is the level of water in the reservoir just prior to commencement of water recirculation through the ice making machine. When the recirculating pump (not shown) is activated the water level immediately drops to level B by the amount of water which dwells in the ice making machinery during the ice forming process. Once the water level drops to level B, the float 22 and water supply inlet 24 collectively function to replenish reservoir 12 thereby bringing the water level back up to level A. The recirculating pump continues to operate, and as ice is formed in the machinery more water is introduced into the reservoir thereby maintaining level A.

Upon completion of the ice making phase of the operational cycle, the recirculating pump is stopped and the water dwelling in the ice making machine returns to reservoir 12 thereby bringing the water level in the reservoir to maximum level C. During rise of the water level from level A to level C, the following flow occurs in siphon purge system 10. First, as the water level in the reservoir rises to the height of the bight portion 32 of inverted U-shaped tube 26, water drains through the tube and the associated adjustable inlet and outlet tubes, 34 and 36, respectively. Such simple draining continues until the inverted U-shaped tube 26 is completely filled with water. Once this condition occurs, a siphon action is created and both water and sediment 24 are sucked into tube 26 for removal through drain 18 of the reservoir. Such siphon action continues as long as tube 26 is completely filled with water. As the water and sediment are removed the water level drops from high level C to level A thereby exposing the siphon breaker opening 40. Air then enters the inverted U-shaped tube 26 to break the siphon action. The ice making cycle is then repeated.

Figure 3:
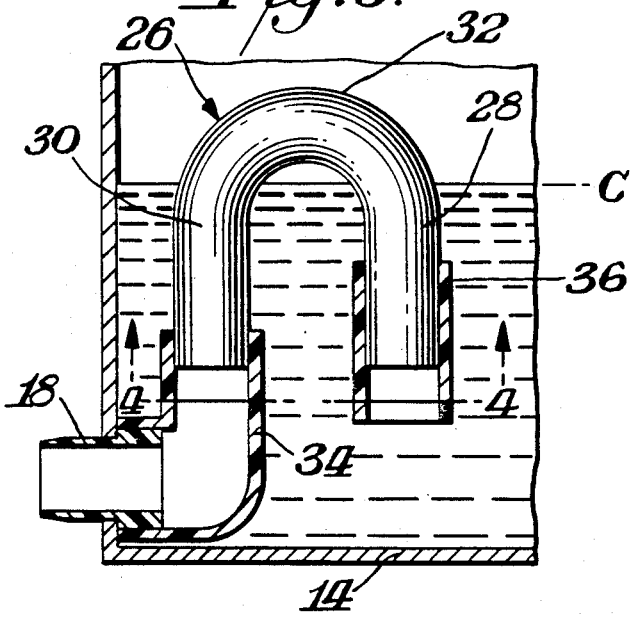
FIG. 3 is a sectional view of the siphon purge system of the present invention but illustrating the system in its inoperative position.

FIG. 3 illustrates siphon purge system 10 in its inoperative position. Bight portion 32 of the inverted U-shaped tube 26 is elevated to a position above the maximum water level C, and in this position no drainage of water or siphon action occurs. Float 22 and water inlet 24 merely function to replenish the amount of reservoir water lost to the harvested ice.

What is claimed is:

1. A siphon purge system for removing water and accumulated sediment from an ice making machine comprising a water reservoir having a bottom wall and an upwardly surrounding side wall, drain opening means in the reservoir, an inverted U-shaped tube mounted in the reservoir having an inlet leg portion, an opposed outlet leg portion and an interconnecting bight portion, means connecting the outlet leg portion of the inverted U-shaped tube to the drain opening means including an adjustable outlet tube connected between the outlet leg portion, and the drain opening means, the inlet leg portion having an open entrance end positioned in close proximity to the bottom wall of the reservoir, and a siphon breaker opening in the bight portion of the inverted U-shaped tube at the inside surface of the U-shape whereby water drains through the inverted U-shaped tube when the water level of the reservoir rises to the level of the bight portion and continues to drain as the water level reaches the full height of the bight portion at which time water and accumulated sediment are siphoned from the bottom wall of the reservoir through the inverted U-shaped tube until the water level of the reservoir drops to below the siphon breaker opening at which time the siphon action is broken, and an adjustable inlet tube at the end of the inlet leg portion of the inverted U-shaped tube.

2. A siphon purge system for removing water and accumulated sediment from an ice making machine as in claim 1 wherein the adjustable outlet tube is constructed and arranged to slidably receive the outlet leg portion whereby the inverted U-shaped tube is adjustable toward and away from the bottom wall of the reservoir.

3. A siphon purge system for removing water and accumulated sediment form an ice making machine as in claim 1 wherein the drain opening means is located in the side wall of the reservoir and the adjustable outlet tube is elbow-shaped.

4. A siphon purge system for removing water and accumulated sediment from an ice making machine as in claim 1 wherein the adjustable inlet tube comprises a section of straight tubing.

5. A siphon purge system for removing water and accumulated sediment from an ice making machine as in claim 1 wherein the adjustable inlet tube is constructed and arranged to slidably receive the inlet leg portion whereby the open entrance end of the inlet leg portion is adjustable relative to the bottom wall of the water reservoir.

* * * * *